United States Patent [19]

Johnson

[11] Patent Number: 4,736,471

[45] Date of Patent: Apr. 12, 1988

[54] TOILET LIGHT

[76] Inventor: Patrick G. Johnson, 1955 33rd Ave., Apt. 10, Longview, Wash. 98632

[21] Appl. No.: 19,078

[22] Filed: Feb. 26, 1987

[51] Int. Cl.[4] ..... A47K 13/00; A47K 17/00

[52] U.S. Cl. ..... 4/234; 4/661; 4/237; 4/DIG. 6

[58] Field of Search ..... 4/661, 237, DIG. 6, 4/234; 362/130, 191, 376, 457-458, 802

[56] References Cited

U.S. PATENT DOCUMENTS

| | | | |
|---|---|---|---|
| 3,045,096 | 7/1962 | Clayton | 4/237 X |
| 3,982,288 | 9/1976 | Borne | 4/237 |
| 4,413,364 | 11/1983 | Bittaker et al. | 4/DIG. 6 |
| 4,491,991 | 1/1985 | Harbruck | 4/661 |
| 4,521,919 | 6/1985 | Molloy | 4/661 X |

*Primary Examiner*—Henry K. Artis

*Attorney, Agent, or Firm*—Kolisch, Hartwell & Dickinson

[57] ABSTRACT

A toilet light assembly which is mounted on the underside of a lid for a toilet and has a bulb which is energized by a gravity switch with movement of the lid from a lowered to a raised position.

4 Claims, 1 Drawing Sheet

TOILET LIGHT

BACKGROUND AND SUMMARY OF THE INVENTION

This invention relates to a gravity operated light assembly, and more particularly to a light assembly or unit adapted to be mounted on a hinged member such as the lid of a toilet with energizing or lighting of the bulb or light source in the unit controlled by the position of the lid.

So-called night lights are known, which typically are lighting units equipped with a plug and switch, which are plugged into the socket of an electrical outlet and which when turned on provide a low intensity light source for the room illuminated.

Provided as they are with a switch, they must be switched on to provide the lighting desired, which at night and in the context of bathroom mounting is frequently difficult to perform. To avoid the problem, this type of unit frequently is left on throughout the night, which may be undesirable as providing a level of light which interferes with sleeping, but perhaps more importantly is inconvenient, since it requires knowingly turning the light on before retiring. If this is forgotten, the bathroom lighting system must be turned on, causing temporary night blindness when the user subsequently turns the lights off and returns to the bedroom.

As contemplated by this invention and in a specific and preferred embodiment, a gravity operated lighting assembly is provided mounted on the underside of the lid of a toilet bowl in a generally central region of the lid so as to be framed by the seat of the toilet thus to be fully exposed with the lid and seat swung to their raised, essentially upright position. Since in the usual toilet, the seat and lid are hinged about a common axis, this mounting for the assembly assures that the assembly clears the seat with the lid and seat lowered. The assembly includes a switch which is gravity operated and which closes a circuit to a light source or a bulb in the assembly with the lid raised, and which opens the circuit to deenergize the bulb automatically with lowering of the lid to its generally horizontal covering position over the bowl of the toilet.

In a specific and preferred embodiment, a shade which also functions as a protective shield is further included, extending in covering relation over operating parts in the assembly and, for the most part, snugly lying against the toilet bowl lid with provision made in the shield for the passage of light downwardly from the assembly and generally toward the toilet bowl with the lid raised.

A general object of the invention, therefore, is to provide a novel light assembly which is controlled by gravity operated switch means whereby the assembly is responsive to the attitude assumed by the assembly.

Another object is to provide, in combination with the seat and lid of a toilet, a switch assembly which is exposed with the seat and lid raised to a substantially vertical position, and which is actuated with a light source therein energize or deenergize depending upon the position of the lid.

Another object is to provide such an assembly which is a self-contained unit and which is adapted to be detachably mounted on the underside of a lid in a toilet combination.

In a specific and preferred form of the invention, and as contemplated herein, the assembly includes a shade functioning also as a shield which covers the operating parts of the assembly with such mounted on the underside of the lid of a toilet bowl.

These and other objects are obtained by the invention which is described hereinbelow in conjunction with the accompanying drawings, wherein.

Figure 2:
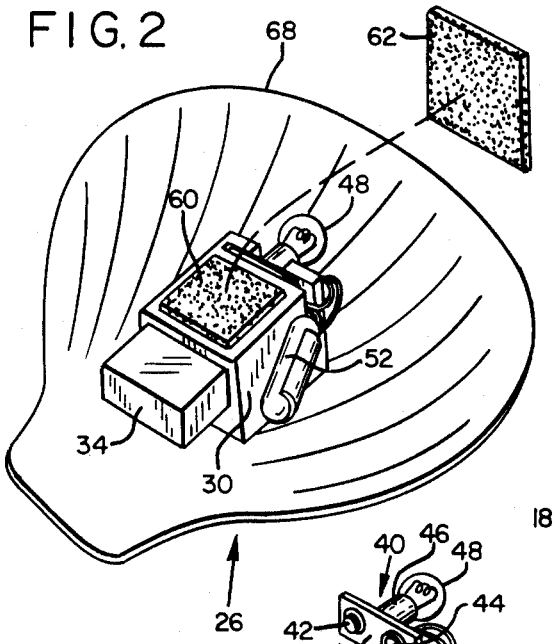
FIG. 2 is a perspective view, on a slightly enlarged scale illustrating the switch assembly.
Figure 1:
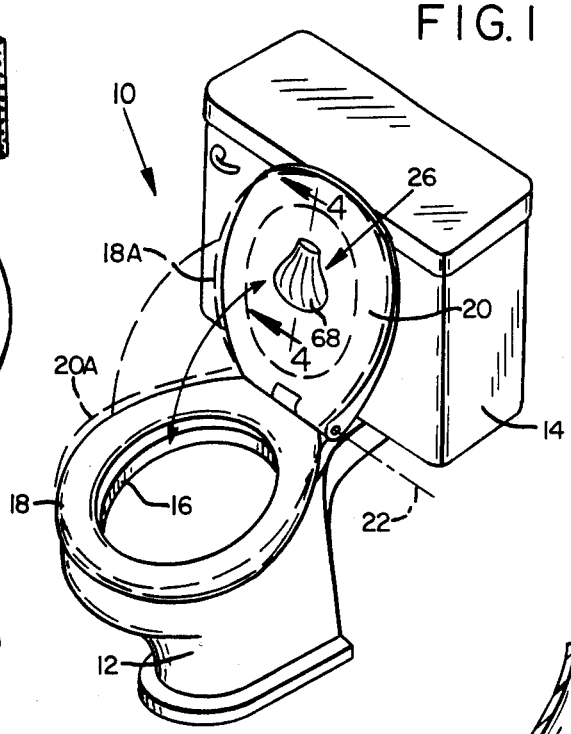
FIG. 1 is a perspective view illustrating a toilet provided with a hinged seat and lid, the lid having mounted on the underside thereof, and so as to be framed by the seat with such raised, a switch assembly as contemplated.
Figure 3:
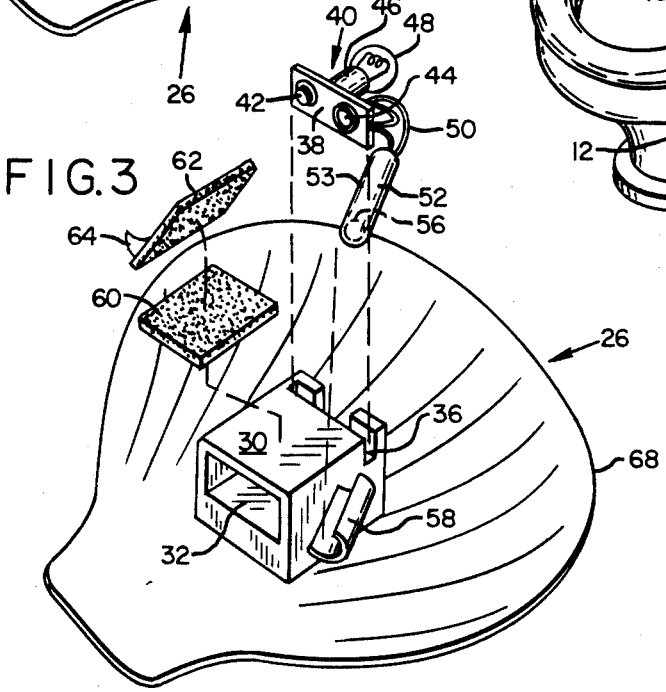
FIG. 3 is a view similar to FIG. 2 but illustrating in an exploded view various components of the assembly.

Referring now to the drawings and, first of all, more particularly to FIG. 1, illustrated generally at 10 is a toilet which includes a bowl 12 which is mounted on the floor and a water-containing tank portion 14 which holds the water used in flushing the toilet. As is usual with the conventional toilet, the bowl 12 includes at the top thereof a rim, partially shown at 16, defining the opening to the bowl.

The toilet further includes a seat 18 and a lid 20. These are suitably mounted whereby such are hinged to the bowl for pivotal movement about a common generally horizontally extending axis shown at 22. The pivot mounting accommodates pivotal movement of the seat and lid from a lowered substantially horizontally position to a raised substantially upright position. In FIG. 1, the seat is shown in solid outline in its lowered position with such resting on the rim of the toilet, and the lid is shown in solid outline in its upright position where the back thereof normally comes into contact with tank portion 14. The seat in its raised position is indicated in dashed outline at 18A, the seat then lying against the underside of the lid. The lid is shown in its lowered position in dashed outline at 20A the lid, in such position, lying against the top of the seat.

With further reference to FIG. 1, shown generally at 26 is a light assembly or unit, which, as will be described in more detail, includes a bulb or light source which is caused to be energized with the lid raised and deenergized with the lid lowered. The assembly is mounted on the underside of the lid substantially centrally of the lid, and has an overall profile which is substantially less than the center opening of seat 18. As a consequence, the assembly is framed by the opening of this seat with the seat raised, and thus is fully exposed whether the seat is in its lowered or raised position. Further, with the lid lowered, the assembly clears the seat to occupy the space encompassed by the central opening of the seat.

Referring now also to FIGS. 2 through 5, the particular light assembly illustrated comprising what is referred to herein as a frame 30, which in the embodiment shown has an essentially block-like configuration and includes a cavity 32 adapted snugly to receive a battery such as the common "A" battery which is readily commercially available and which is illustrated in the drawings at 34. Also, part of the frame 30 is a slot 36 adapted snugly and detachably to receive bar portion 38 of bulb-mounting assembly 40. Bar 38 mounts two terminals 42, 44 and with element 44 in place, these terminals contact respective poles of battery 34.

Element 40 further includes a socket portion 46 for detachably mounting a bulb or electrically operated light source 48. The socket may be of conventional form of the type that is found in many flashlights where the bulb is inserted and twisted against a biasing action to seat in place and to establish electrical connection with suitable conductors therein.

Also part of the bulb-mounting element, and connected thereto by conductors 50, is a gravity operated switch device 52. A form of such device includes a glass envelope and disposed therewithin a movable conductive mass such as a mercury pool 56. The switch device is such that with the envelope inclined downwardly away from the location of the entrance of the conductors 50, an open circuit exists through the switch device, and with inclination of the envelope in the opposite direction and movement of the pool to the opposite end of the envelope, a closed circuit is established through the device. The envelope is supported adjacent a side of the frame through cradle clip 58 which may be an integral part of the frame and snugly receives the envelope.

Figure 6:
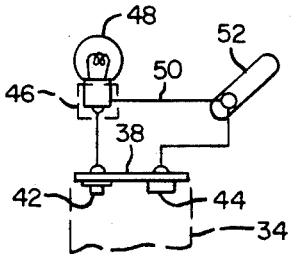
FIG. 6 illustrates schematically an electrical circuit in the assembly.

FIG. 6 illustrates schematically the electrical circuit which is provided between electrodes 42, 44 of bar 38, the bulb, and switch device 52. Referring to the figure, one of the terminals 42 may be directly connected to one of the electrodes of the bulb within socket 46. The other electrode or the bulb extends through a conductor to switch device 52 with the other contact of the switch device being electrically connected via a conductor to terminal 44.

Light assembly 26 has means provided along one side thereof for detachably mounting the same against the underside of lid 20. In the specific form of the invention shown, such may include a Velcro® type of attachment, wherein cooperating expanses having hook and loop structures interengage to produce the attachment. In the drawings, one of such expanses is indicated at 60 and such is secured to a side of the frame. The other expanse is indicated at 62, and such is secured to the underside of the toilet lid. Securement of expanse 62 to the lid may be done adhesively. Thus, a film of pressure sensitive adhesive may be applied over the back of expanse 62 detachably covered by protective layer 64 which is removed to expose the adhesive film whereby with pressure, expanse 62 adheres to the side of the lid.

Figure 4:
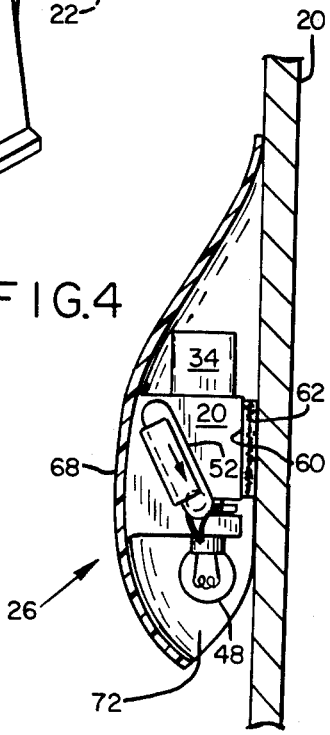
FIG. 4 is a cross-sectional view on a somewhat enlarged scale taken generally along the line 4—4 in FIG. 1.
Figure 5:
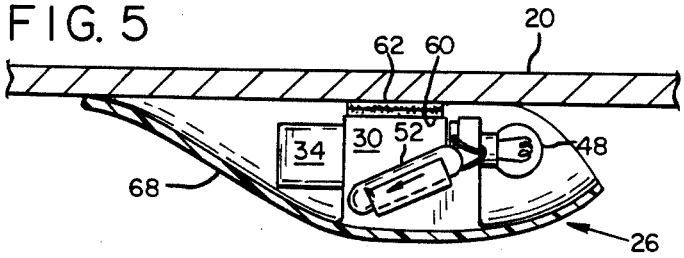
FIG. 5 is a view similar to FIG. 4 but showing the assembly as such would appear with the lid of the toilet bowl in a lowered position.
Figure 7:
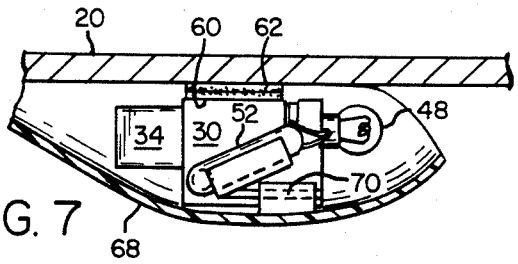
FIG. 7 illustrates a modified form of the invention.

Also part of the light assembly is a shade portion 68. Such may take various artistic shapes and, in the particular construction illustrated, takes the shape of a clam shell. The shade portion may be formed as an integral part of frame 30, as shown in the form of the invention illustrated in FIG. 4, or may be detachably mounted on the frame, as with detachable clip 70 illustrated in the modification of the invention shown in FIG. 7. The shade portion normally is made from a light impervious substance, such as an opaque plastic. The shade portion extends in covering relation over operative parts of the light assembly, with the skirt or edge thereof in snug adjacency to the underside of the lid save for an opening such as the one shown at 72 which is defined at the base of the shade portion with the lid in its upright position. Such opening provides for the passage of light downwardly past the shade portion to illuminate the toilet bowl below it with the lid upright as shown in FIGS. 1 and 4. By so configuring the shade portion, such additionally functions as a shield protecting the interior of the light assembly and preventing extraneous foreign matter from traveling down the lid and into the interior of the assembly. The snug contact of the shade portion with the lid also contributes to ease of cleaning of the lid.

The operation of the light assembly should be obvious. With the assembly in place and with the lid lowered and in its horizontal position, the gravity operated switch device opens with deenergizing of bulb 48. Movement of the lid to its upright position causes the metallic mass within the switch to move to the opposite end of the envelope 53 closing the switch and producing illumination of the bulb through the battery 34. Lighting is provided whether the seat 18 is occupying its lowered or its raised position. To replace a battery or a bulb, the frame 30 is removed for separation of the Velcro® expanses 60, 62. Alternatively, and in the form of the invention shown in FIG. 7, the shade may be removed independently of the frame to provide access to the bulb mounting and battery mounting.

With the light assembly incorporated with the lid of a toilet, actuation of the light in the assembly is produced through an act normally accompanying toilet usage, i.e. raising of the lid.

While there has been described modifications of the instant invention, it should be obvious that variations are possible without departing from the invention.

It is claimed and desired to secure by Letters Patent:

1. In combination with a toilet including a toilet bowl, a seat including a central opening and a lid, the lid and seat being hinged to the bowl and having a lowered position overlying the bowl and a raised substantially upright position, a light assembly mounted on the under side of the lid in a position framed by the seat opening with the seat and lid in an upright position, said assembly including an electrically operated light source, electric current supply means for supplying current to energize the light source, and a circuit connecting the supply means and source including a gravity operated switch, said switch being adjustable to close the circuit between said light source and supply means with the lid upright and to open the circuit with the lid in its lowered position said assembly further including a frame having mounted thereon said light source, supply means, and circuit and the mounting of the assembly on the lid being through securement of said frame to said lid, said assembly also further including a shield element mounted on said frame in covering relation over said frame and the light source, supply means, and circuit.

2. The combination of claim 1, wherein said shield element with the lid in its said upright position includes light passage means that faces downwardly from the base of the shield element and further includes a skirt portion extending from one side of said light passage means about the shield element to the other side of said light passage means disposed in snug adjacency with the underside of said lid.

3. The combination of claim 1, wherein said shield element is detachably mounted on said frame with removal of said shield element from said frame exposing said light source, electric current supply means, and circuit.

4. In combination with a toilet including a toilet bowl, a seat including a central opening and a lid, the lid and seat being hinged to the bowl and having a lowered position overlying the bowl and a raised substantially upright position, a light assembly disposed on the other side of the lid in a position framed by the seat opening with the seat and lid in an upright position, said assembly including a frame detachably mounted on the underside of said lid, a light source mounted on said frame, electric current supply means mounted on said frame for supplying current to energize the light source, and a circuit mounted on said frame connecting the supply means and light source including a gravity operated switch which is adjustable to close the circuit between said light source and its supply means with the lid upright and to open the circuit with the lid in its lowered position, said assembly further including a shade element mounted on said frame extending in encompassing relation about the periphery of the frame and in covering relation over said light source, supply means, and circuit, said shade element including light passage means which in conjunction with the underside of said lid defines a light passage channel that faces downwardly from the base of the shade element, said shade element including a skirt portion extending from one side of said light passage means about the shade element to the other side of said light passage means disposed in snug adjacency with the underside of said lid.

* * * * *